US010609981B1

(12) United States Patent
Phinney

(10) Patent No.: US 10,609,981 B1
(45) Date of Patent: Apr. 7, 2020

(54) INSOLE SANDAL AND SHOE SYSTEM

(71) Applicant: Owen Gerard Phinney, Gansevoort, NY (US)

(72) Inventor: Owen Gerard Phinney, Gansevoort, NY (US)

( * ) Notice: Subject to any disclaimer, the term of this patent is extended or adjusted under 35 U.S.C. 154(b) by 344 days.

(21) Appl. No.: 15/334,475

(22) Filed: Oct. 26, 2016

Related U.S. Application Data

(60) Provisional application No. 62/246,889, filed on Oct. 27, 2015.

(51) Int. Cl.

| | |
|---|---|
| ***A43B 3/12*** | (2006.01) |
| ***A43B 3/02*** | (2006.01) |
| ***A43B 13/04*** | (2006.01) |
| ***A43B 13/02*** | (2006.01) |
| ***A43B 23/07*** | (2006.01) |
| ***A43B 7/14*** | (2006.01) |

(52) U.S. Cl.
CPC ..... *A43B 3/126* (2013.01); *A43B 3/02* (2013.01); *A43B 3/128* (2013.01); *A43B 7/142* (2013.01); *A43B 7/143* (2013.01); *A43B 7/144* (2013.01); *A43B 7/149* (2013.01); *A43B 7/1425* (2013.01); *A43B 13/026* (2013.01); *A43B 13/04* (2013.01); *A43B 23/07* (2013.01)

(58) Field of Classification Search
CPC .... A43B 3/18; A43B 3/26; A43B 3/16; A43B 3/163; A43B 3/22; A43B 7/26; A43B 3/126; A43B 3/02; A43B 3/128; A43B 3/00; A43B 3/10; A43B 3/101; A43B 3/12; A43B 3/24; A43B 7/142; A43B 7/1425; A43B 7/143; A43B 7/144; A43B 7/149; A43B 7/00; A43B 11/00; A43B 13/026; A43B 13/04; A43B 13/36; A43B 17/16; A43B 17/18; A43B 19/00; A43B 23/00; A43B 23/07
USPC ... 36/10, 11.5, 101, 100, 7.5, 56, 7.1 R, 7.3, 36/7.6
See application file for complete search history.

(56) References Cited

U.S. PATENT DOCUMENTS

| | | | | |
|---|---|---|---|---|
| 814,061 A * | 3/1906 | Mahoney | A43B 3/0031 | 36/1 |
| 5,499,459 A * | 3/1996 | Tomaro | A43B 1/0045 | 36/10 |
| 5,787,608 A * | 8/1998 | Greenawalt | A43B 3/128 | 36/11.5 |
| 6,021,585 A * | 2/2000 | Cole | A43B 3/122 | 36/11.5 |

(Continued)

*Primary Examiner* — Anna K Kinsaul
*Assistant Examiner* — F Griffin Hall
(74) *Attorney, Agent, or Firm* — Maxine L. Barasch; Keohane & D'Alessandro PLLC

(57) ABSTRACT

Embodiments provide an insole sandal and a shoe without a tongue. The insole sandal has a first surface configured to interface with a foot of a wearer; and a second surface configured to interface with a ground surface, and a bottom of an interior of a shoe. The insole sandal further has a strap configured to hold the insole to the foot of the wearer when the insole sandal is worn as a sandal. The first surface and the second surface are on opposite sides of one another. The insole sandal is configured to fit within the interior of the shoe. The shoe is configured to receive the insole sandal in its interior. The bottom of the insole sandal and an inner sole of the shoe may have complementary protrusions and depressions.

15 Claims, 8 Drawing Sheets

(56) References Cited

U.S. PATENT DOCUMENTS

| | | | | |
|---|---|---|---|---|
| 7,134,225 | B2 * | 11/2006 | Ashton | A43C 11/12 36/94 |
| 7,140,129 | B2 * | 11/2006 | Newson | A43B 5/18 36/100 |
| 7,222,442 | B2 * | 5/2007 | Hillyer | A43B 3/103 36/10 |
| 7,578,076 | B2 * | 8/2009 | Pawlus | A43B 3/0047 36/100 |
| 8,677,653 | B2 * | 3/2014 | Avar | A43B 3/242 36/50.1 |
| 8,914,997 | B2 * | 12/2014 | Adami | A43B 3/0047 36/100 |
| 8,959,795 | B2 * | 2/2015 | Cristea | A43B 3/102 36/100 |
| 2003/0093919 | A1 * | 5/2003 | Wang | A43B 17/16 36/10 |
| 2009/0183392 | A1 * | 7/2009 | Shane | A43B 1/0027 36/97 |
| 2010/0236100 | A1 * | 9/2010 | Ho | A43B 1/0081 36/100 |
| 2013/0067767 | A1 * | 3/2013 | Casto | A43B 5/00 36/85 |
| 2014/0317964 | A1 * | 10/2014 | Chou | A43B 7/12 36/136 |
| 2015/0000160 | A1 * | 1/2015 | Giraldo | A43B 3/242 36/101 |
| 2015/0245688 | A1 * | 9/2015 | Young | A43B 19/00 36/10 |
| 2017/0027272 | A1 * | 2/2017 | Yeglinski, II | A43B 3/24 |
| 2017/0231324 | A1 * | 8/2017 | Arquilla | A43B 23/07 36/10 |

* cited by examiner

INSOLE SANDAL AND SHOE SYSTEM

PRIORITY CLAIM

The present patent document is a non-provisional patent application claiming the benefit of the filing date of provisional patent application Ser. No. 62/246,889 filed Oct. 27, 2015, the entire contents of which is incorporated herein by reference.

FIELD OF THE INVENTION

Embodiments of the present invention relate to footwear and, more particularly, to an insole sandal and show.

BACKGROUND OF THE INVENTION

People change types of footwear for various activities or weather conditions. The type of shoe an individual wears while on a beach, such as a pair of flip-flops, is different from the type of shoe worn walking a mile to the beach, such as a pair of sneakers. Additionally, one may wear a particular type of shoe during rain, such as galoshes, but another when it is warm and sunny, such as a dress shoe. Carrying multiple pairs of shoes is cumbersome. Additionally, a person may not know of a weather pattern change ahead of time, or receive early notice of an activity in which they would like to participate. For these and other reasons, there exists a need for improved and versatile footwear.

SUMMARY OF THE INVENTION

In some aspects, embodiments of the invention provide an insole sandal comprising: a sole having a first surface configured to interface with a foot of a wearer; and a second surface. The second surface is configured to interface with a ground surface, and a bottom of an interior of a shoe. The insole sandal further has a strap configured to hold the insole sandal to the foot of the wearer when the insole sandal is worn as a sandal. The first surface and the second surface are on opposite sides of one another. The insole sandal is configured to fit within the interior of the shoe.

In some aspects, embodiments of the invention provide a system comprising: a shoe with a split and no tongue; and an insole sandal. The insole sandal has a first surface configured to interface with a foot of a wearer; and a second surface configured to interface with: a ground surface, and a bottom of an interior of a shoe. The insole sandal further has a strap configured to hold the insole to the foot of the wearer when the insole sandal is worn as a sandal. The strap has an extended protrusion which acts as a tongue when the insole sandal is worn inside the shoe. The first surface and the second surface are on opposite sides of one another. The insole sandal is configured to fit within the interior of the shoe.

BRIEF DESCRIPTION OF THE FIGURES

These and other objects, features, and characteristics of the present invention will become more apparent to those skilled in the art from a study of the following detailed description in conjunction with the appended claims and drawings, all of which form a part of this specification. In the drawings:

Figure 1:
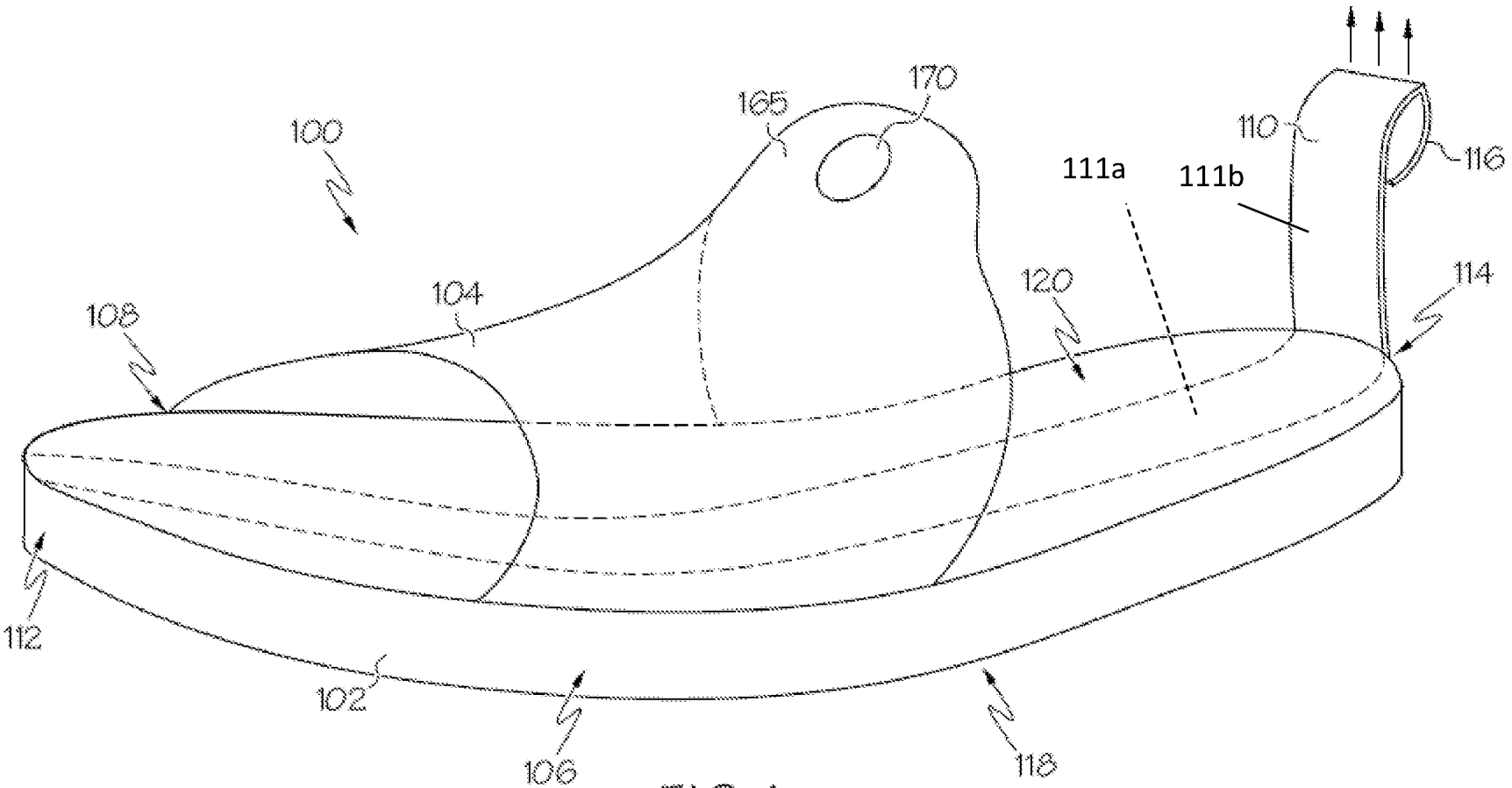
FIG. 1 is a side perspective view of an insole sandal in accordance with embodiments of the invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. When used, like numbering represents like elements.

DETAILED DESCRIPTION OF EMBODIMENTS OF THE INVENTION

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

Embodiments provide an insole sandal and a shoe. The insole sandal has a first surface configured to interface with a foot of a wearer; and a second surface configured to interface with a ground surface, and a bottom of an interior of a shoe. The insole sandal further has a strap configured to hold the insole to the foot of the wearer when the insole sandal is worn as a sandal. The first surface and the second surface are on opposite sides of one another. The insole sandal is configured to fit within the interior of the shoe. The shoe is configured to receive the insole sandal in its interior. The bottom of the insole sandal and an inner sole of the shoe may have complementary protrusions and depressions.

Referring to FIG. 1, there is shown a perspective view of an insole sandal in accordance with embodiments of the invention. The insole sandal 100 has sole 102 having on a first side a first surface 120 for receiving a person's foot, and on a second side (opposite the first side) a second surface 118 for interfacing with the ground. A strap 104 (or other suitable mechanism) is attached to the sole 102. In some embodiments, the strap 104 attaches at least to two sides 106, 108 of the sole in such a way as to secure a person's foot to the sandal when worn. Strap 104 may include an extended protrusion 165 that covers a portion of the metatarsal area of the foot, and takes the place of, and functions like, a shoe tongue when the insole sandal 100 is worn inside of a shoe. A logo or other design 170 may appear on protrusion 165. The protrusion may be substantially rounded at its crest, as shown, or could be another shape. The protrusion may have padding inside of the fabric or plastic (or other outer covering) for cushioning the front of the user's ankle against the split of a shoe when the insole sandal is worn inside of a shoe. As depicted in FIG. 1, a first portion 111*a* of pull-tab 110 is embedded within the sole 102, between a first sole portion and a second sole portion, from a first end 112 (where a user's toes would fall) to a second end 114 (where a user's heel would fall). A second portion 111*b* of the pull-tab 110 extends beyond the second end of a length greater than the height of a shoe. The pull-tab 110 can, therefore, function as a handle for pulling the insole sandal from the shoe. The pull-tab may have a loop 116 at its outer end to better facilitate a user's hand for pulling. The pull-tab may be made of fabric, mesh, foam, plastic, or other suitable material. The pull-tab is of a length that extends slightly above the back of the shoe. In some embodiments, the pull-tab may extend three to six inches from the heel of the insole sandal 100. For example, the pull-tab may be three inches if it is to be used in conjunction with a running shoe, or five inches if it is to be used in conjunction with a high-top shoe.

Figure 2:
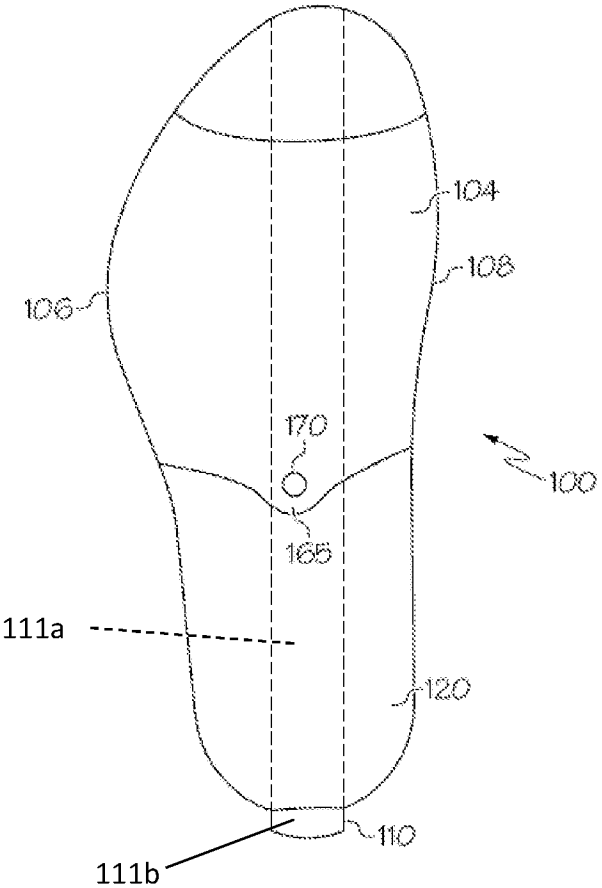
FIG. 2 is a top-down view of the insole sandal of FIG. 1.

FIG. 2 shows a top-down view of the insole sandal 100 of FIG. 1. First surface (i.e., top surface) 120 is shown. Strap 104 extends between sides 106 and 108. Pull tab 110 is shown extending substantially the entire length of the insole sandal. As depicted in FIGS. 1 and 2, the pull-tab 110 includes the first pull-tab portion 111*a* and the second pull-tab portion 111*b* (which is a handle portion). The second pull-tab portion 111*b* has a single end that extends from the sole. Except for the handle portion, the pull-tab 110 is embedded between the first surface 120 (which is the first sole portion) and second surface 118 (which is the second sole portion), shown in FIGS. 1 and 3, and is, accordingly, shown in dashed lines. The second pull-tab portion 111*b* is non-embedded. Note that in other embodiments, the pull tab may extend only half the length or other suitable length of the insole sandal 100. The first surface 120 of the sole may be soft for providing comfort to a person's foot. In some embodiments, the first surface 120 of the sole may be made of fabric, textile, rubber, plastic, mesh, foam, leather, composite, and/or other suitable material.

Figure 3:
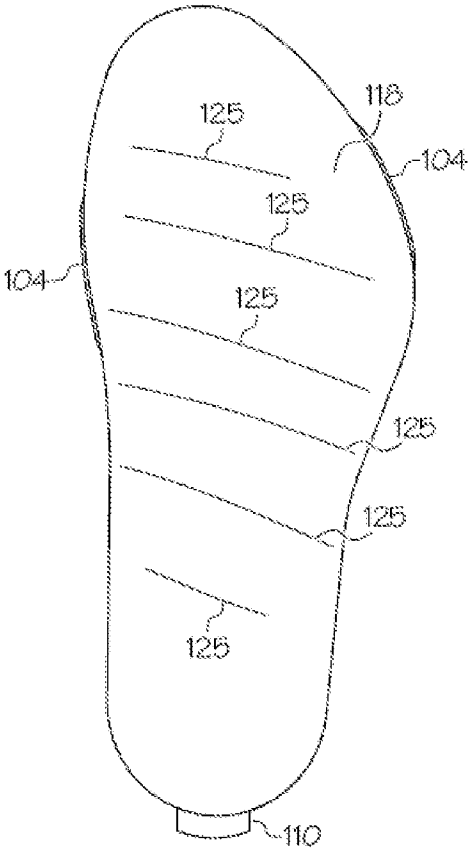
FIG. 3 is a bottom-up view of the insole sandal of FIG. 1.

FIG. 3 shows a bottom-up view of insole sandal 100 of FIG. 1. The second surface 118 of the sole may be tough and rough, as shown by depression lines 125, for engaging with the ground or bottom inside of a shoe. The second surface of the sole may be made of rubber, plastic, mesh, foam, leather, composite, and/or other suitable material.

Figure 4:
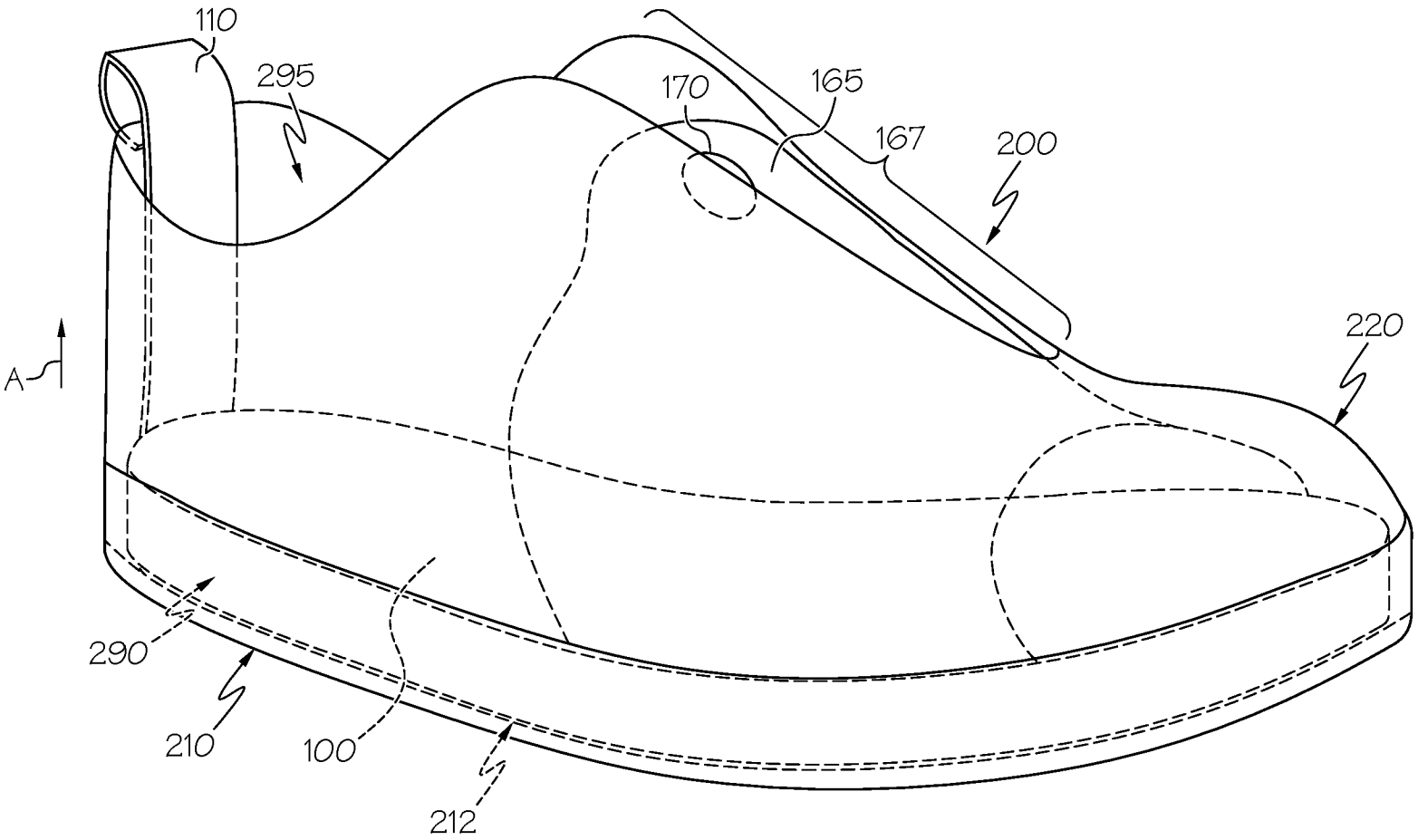
FIG. 4 is a side perspective view of an insole sandal inside of a shoe in accordance with embodiments of the invention.

FIG. 4 shows the insole sandal 100 positioned inside of a shoe 200. In embodiments, the shoe may be a sneaker, boot, boat shoe, high-top shoe, or other suitable foot covering. In the example shown, the shoe includes a split (or "slit") 167 without a tongue or laces. Extended protrusion 165 takes the place of, and is configured to act as, a shoe tongue when the insole sandal is worn inside of a shoe. The shoe typically has a substantially rigid outer sole 210 for interfacing with the ground, and shell 220 for covering the foot. Bottom portion 210 may be made from rubber, plastic, mesh, foam, leather, composite, and/or other suitable material. Upper portion/shell 220 may be textile, fabric, rubber, plastic, mesh, foam, leather, composite, and/or other suitable material. As shown, the insole sandal 100 fits into an interior 295 of the shoe. The inner sole 212 (bottom of the shoe without an insole) of the shoe is configured with a cavity 290 in which the insole sandal 100 fits. While the insole sandal 100 is situated inside the shoe, the strap 104 may interface (i.e., touch the underside of the upper portion of the shoe), or instead, may leave some space. Note that a user may pull on tab 110 in an upward direction as shown by arrow A to lift the insole sandal 100 out of the shoe 200.

Figure 5:
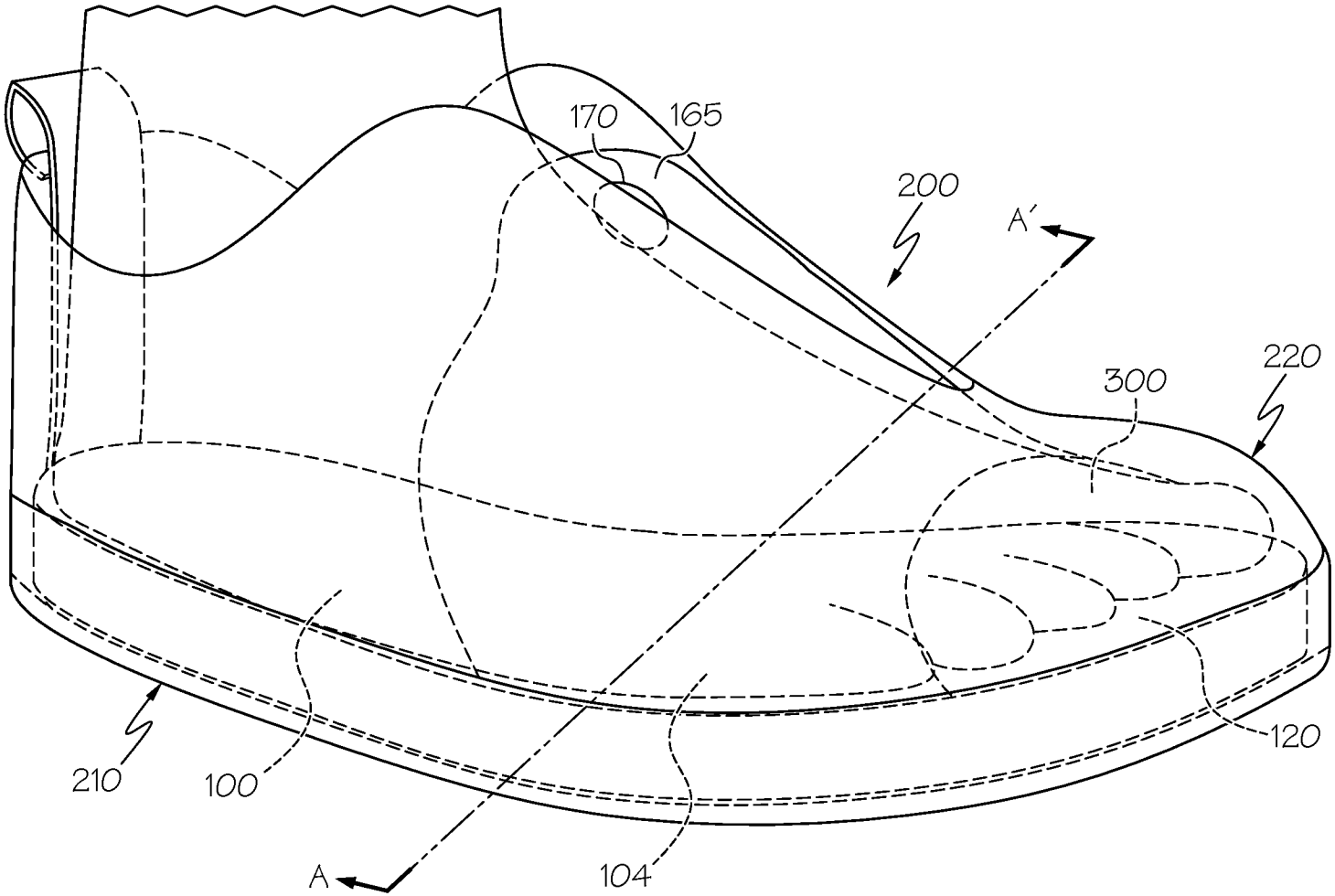
FIG. 5 is a side perspective view of an insole sandal and shoe worn by a person.

FIG. 5 shows sandal 100 positioned inside of shoe 200, and worn by a user. A user's foot 300 is shown engaged on surface 120 of the insole sandal 100 and under strap 104 while covered by the shoe's shell 220. A user can wear the insole sandal 100 and slip the insole sandal 100 and foot into shoe 200 together, or manually put the sandal insole into the shoe prior to slipping his/her foot in. The user can then tie or otherwise secure the shoe 200 to his foot 300, if necessary, and perform activities typically performed while wearing shoes, such as walking, running, jumping, etc.

Figure 6:
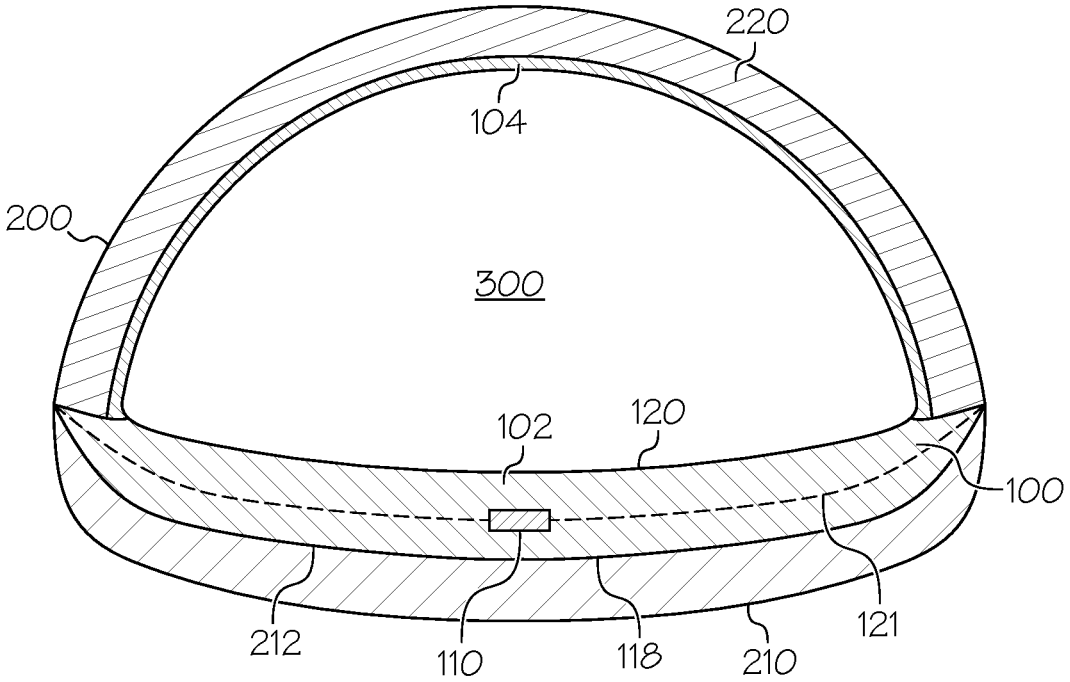
FIG. 6 is a cross-sectional view of a foot, insole sandal, and sneaker along line A-A' of FIG. 5.

FIG. 6 shows a cross-section of the shoe 200, insole sandal 100, and foot 300 positioned as in FIG. 5 cut along line A-A'. The insole sandal 100 is shown resting on inner sole 212 in the cavity of the shoe 200 (cavity outlined by shell 220 and inner sole 212), and the foot 300 is disposed under strap 104 and on top of surface 120 of insole sandal 100 inside of shoe 200. Line 121 represents a break between the top surface 120 and bottom surface 118 so that the pull tab 110 can be sandwiched in between during construction. In some embodiments, the cavity and bottom portion 102 of insole sandal 100 are configured to have dimensions creating a snug fit. In such case, friction can help keep insole sandal 100 in place in the cavity when the shoe 200 and insole sandal 100 are worn. In other embodiments, the insole of a typical shoe may be removed, and insole sandal 100 installed for wearing.

Figure 7:
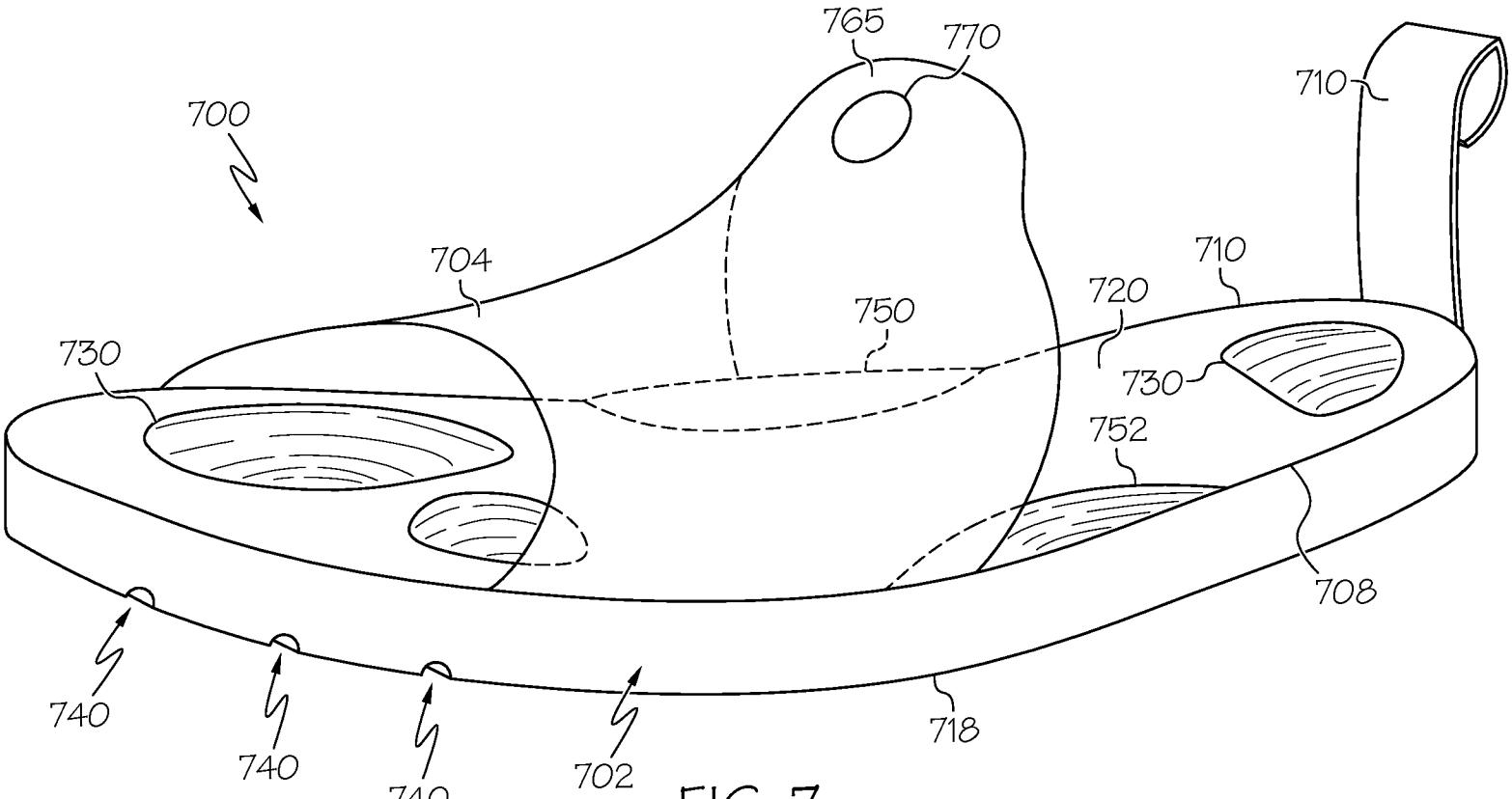
FIG. 7 is a side perspective view of another sandal insole in accordance with embodiments of the invention.

FIG. 7 shows an embodiment of an insole sandal 700 in accordance with some embodiments of the invention. Insole sandal 700 has a sole 702 and a strap 704, as well as pull tab 710. Strap 704 includes an extended protrusion 765, which functions as a tongue when the insole sandal 700 is worn inside of a shoe. In the example, the insole sandal 100 has indentations/depressions 740 on the second surface (i.e., bottom surface) 718 of sole 702. Although three indentations/depressions 740 are shown, in some embodiments, there may be more or fewer present. The inner sole (i.e., 212 of shoe 200) of a shoe may include protrusions that are the positive image to the negative image of the indentations 740.

Figure 8:
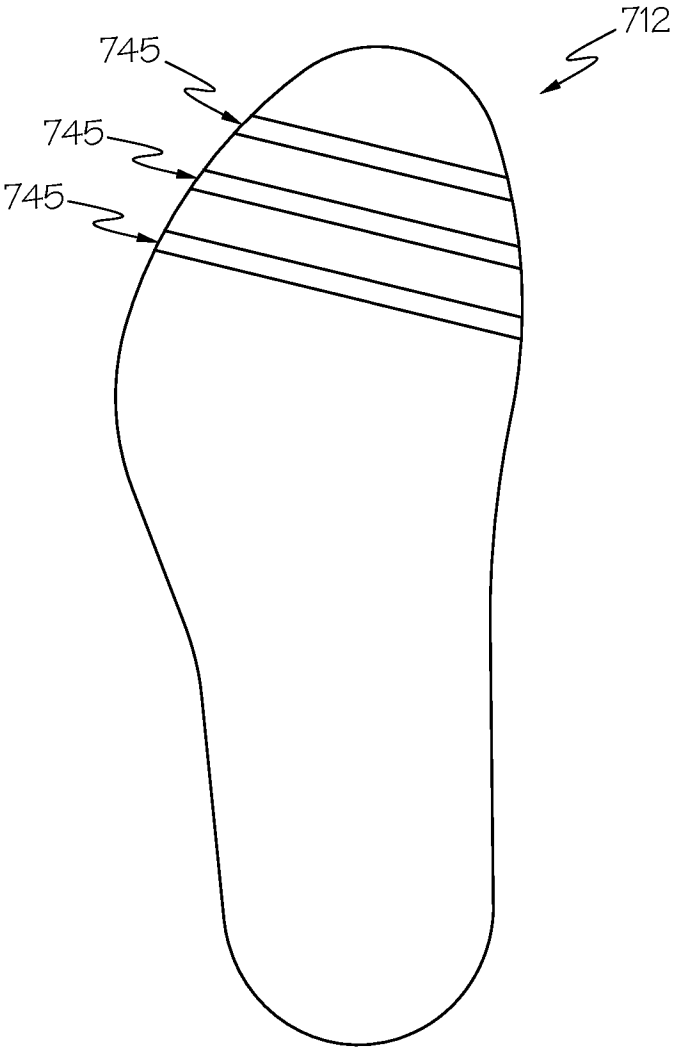
FIG. 8 shows a top-down view of an inner sole of a shoe of FIG. 10, with the shell removed for clarity.

FIG. 8 shows a top-down view of an inner sole 712 of a sneaker 780 (FIG. 10) with the shell removed for clarity. The inner sole 712 has protrusions 745 for interfacing with depressions 740. In some embodiments, the insole sandal can have protrusions, and the shoe can have depressions. In some embodiments, the insole sandal can have the negative image while the inner sole can have the positive image, or vis versa. In some embodiments, both the insole sandal and shoe have complementary depressions and protrusions opposing one another. The protrusions and depressions can help keep the insole sandal 700 in place through friction while in a shoe.

Figure 9:
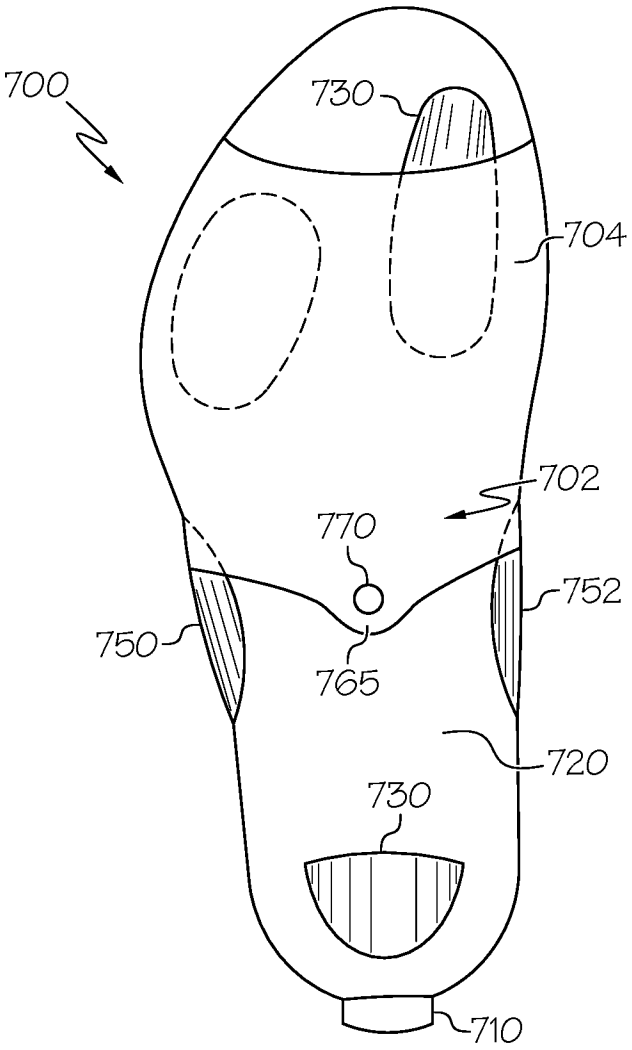
FIG. 9 is a top-down view of the insole sandal of FIG. 7.

Referring back to FIG. 7, the insole sandal 700 is shown with supporting elements 750 and 752 on each side 708 and 710. These structures may extend substantially vertically from the sole 702. The structures may be made from leather, plastic, textile, and/or other suitable material, and provide support to the foot of a user while worn. They may be firm in structure to hold the foot in place. Pads 730 are also included on the first surface (i.e. top surface) 720 to comfort and support a user's foot. FIG. 9 shows a top-down view of the sandal of FIG. 8.

Figure 10:
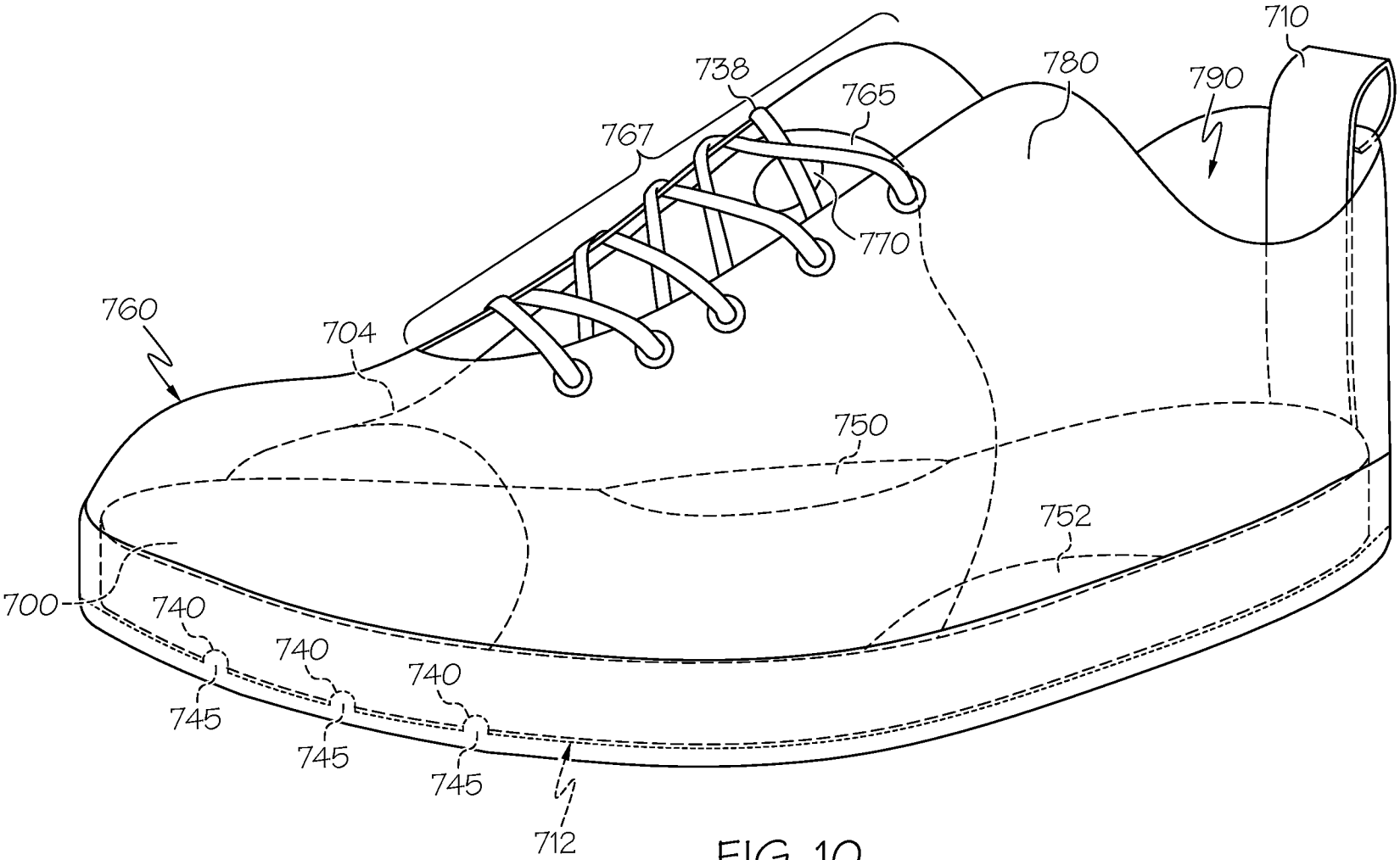
FIG. 10 is a side perspective view of an insole sandal inside of a split tongue shoe in accordance with embodiments of the invention.

FIG. 10 shows the insole sandal 700 of FIG. 7 inside of a sneaker 780. Sneaker 780 includes a split (or "slit") 767 and laces 738, but no tongue. Insole sandal 700 rests inside of sneaker 780 in cavity 790. Extended protrusion 765 extending outwardly from strap 704 acts as a shoe tongue when worn inside of the sneaker 780. A user can slip his/her foot into the shoe opening to wear the sneaker 780 and insole sandal 700. Support structures 750 and 752 rest against the inside of the sneaker shell, as shown at 760. Depressions 740 and protrusions 745 are shown complementing one another.

While the disclosure outlines exemplary embodiments, it will be appreciated that variations and modifications will occur to those skilled in the art. Components of the insole sandal and shoe can be modified in terms of shape, size, etc. without departing from the scope and spirit of the invention. In particular regard to the various functions performed by the above described components, the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of embodiments of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of embodiments of the invention.

I claim:

1. An insole sandal consisting of:

a sole having:

a first sole portion and a second sole portion connected to one another;

a first surface, on the first sole portion, configured to interface with a foot of a wearer;

a second surface, on the second sole portion, configured to interface with a ground surface, and a bottom of an interior of a shoe;

a strap configured to hold the insole sandal to the foot of the wearer when the insole sandal is worn as a sandal; and a pull-tab;

wherein the first surface and the second surface are on opposite sides of one another;

wherein the pull-tab has a first pull-tab portion and a second pull-tab portion;

wherein the first pull-tab portion is embedded in between the first sole portion and the second sole portion, wherein the embedded first pull-tab portion extends substantially straight across an entire length of the sole, from a first end of the sole where a user's toes would fall when the insole sandal is worn, to a second end where the user's heel would fall when the insole sandal is worn, wherein the second pull-tab portion is non-embedded in the sole, and wherein the second pull-tab portion comprises a handle with a grip loop;

wherein the second pull-tab portion has a single end that extends from the sole;

wherein the insole sandal is configured to fit within the interior of the shoe; and wherein the second surface has depressions and protrusions that are complementary to depressions and protrusions of the shoe.

2. The insole sandal of claim 1, wherein the first surface is comprised of one or more of the group: fabric, textile, rubber, plastic, mesh, foam, leather, or composite.

3. The insole sandal of claim 1, wherein the second surface is comprised of one or more of the group: rubber, plastic, mesh, foam, leather, or composite.

4. The insole sandal of claim 1, further includes support pads on the first surface.

5. The insole sandal of claim 1, wherein the strap has a protruding portion which is configured to act as a shoe tongue.

6. A system consisting of:

a shoe; and an insole sandal without a tongue, the insole sandal comprising:

a first sole portion and a second sole portion connected to one another;

a first surface, on the first sole portion, configured to interface with a foot of a wearer;

a second surface, on the second sole portion, configured to interface with a ground surface, and a bottom of an interior of a shoe;

a strap configured to hold the insole to the foot of the wearer when the insole sandal is worn as a sandal, wherein the strap has an extended protrusion; and a pull-tab;

wherein the first surface and the second surface are on opposite sides of one another;

wherein the pull-tab has a first pull-tab portion and a second pull-tab portion;

wherein the first pull-tab portion is embedded in between the first sole portion and the second sole portion, wherein the embedded first pull-tab portion extends substantially straight across an entire length of the sole, from a first end of the sole where a user's toes would fall when the insole sandal is worn, to a second end where the user's heel would fall when the insole sandal is worn, wherein the second pull-tab portion is non-embedded in the sole, and wherein the second pull-tab portion comprises a handle with a grip loop;

wherein the second pull-tab portion has a single end that extends from the sole;

wherein the insole sandal is configured to fit within the interior of the shoe; and wherein the second surface has depressions and protrusions that are complementary to depressions and protrusions of the shoe.

7. The system of claim 6, wherein the pull-tab is made of one or more of the following: fabric, mesh, foam, plastic, or other suitable material.

8. The system of claim 6, wherein the pull-tab extends three to six inches from the heel of the insole sandal.

9. The system of claim 6, wherein the shoe includes a sole which includes a cavity configured to receive the insole sandal.

10. The system of claim 6, wherein the shoe is a sneaker.

11. The system of claim 6, wherein the shoe has a split and the strap has a protruding portion which acts as a shoe tongue when worn.

12. The system of claim 6, wherein the first surface is comprised of at least one of: fabric, textile, rubber, plastic, mesh, foam, leather, or composite.

13. The system of claim 6, wherein the second surface is comprised of rubber, plastic, mesh, foam, leather, or composite.

14. The system, of claim 6, wherein the shoe includes an upper portion shell, an inner sole, and an outer sole.

15. The system of claim 1, wherein the shoe includes support structures on the bottom of the interior of the shoe.

* * * * *